United States Patent [19]

Weller et al.

[11] 4,364,476

[45] Dec. 21, 1982

[54] PLASTIC LID WITH STACKING SEPARATION MEANS

[75] Inventors: Kenneth G. Weller, Golden Valley; James V. Ostrum, St. Paul, both of Minn.

[73] Assignee: Shamrock Industries, Inc., New Hope, Minn.

[21] Appl. No.: 337,164

[22] Filed: Jan. 5, 1982

[51] Int. Cl.[3] ..... B65D 21/02; B65D 43/10

[52] U.S. Cl. ..... 206/508; 220/306; 220/380

[58] Field of Search ..... 220/306, 307, 380, 366, 220/367; 206/503, 508, 509

[56] References Cited

U.S. PATENT DOCUMENTS

| | | | |
|---|---|---|---|
| 3,173,574 | 3/1965 | Goldsmith | 220/306 |
| 3,269,588 | 8/1966 | Ruekberg | 220/306 |
| 4,014,459 | 3/1977 | Robinson | 206/508 |
| 4,275,815 | 6/1981 | Davis | 206/508 |

FOREIGN PATENT DOCUMENTS

| | | | |
|---|---|---|---|
| 7808267 | 2/1979 | Netherlands | 206/508 |

*Primary Examiner*—George E. Lowrance

*Attorney, Agent, or Firm*—Williamson, Bains, Moore & Hansen

[57] ABSTRACT

A flexible, plastic lid of the type used for closing commodity containers is provided with protrusion segments on the inside surface of its side wall to provide vent openings between adjacent, stacked lids. A stacking shoulder around the periphery of the top wall of the lid is also provided with raised ribs for further holding stacked lids in spaced apart relation. Vent passages formed between stacked lids by the protrusion segments and the ribs lessen the suction effect which normally tends to hold such lids together when stacked for handling and storage.

7 Claims, 5 Drawing Figures

PLASTIC LID WITH STACKING SEPARATION MEANS

BACKGROUND OF THE INVENTION

This invention relates to plastic lids of the flexible type which are used to close commodity containers, such as plastic ice cream pails. Such lids are normally stacked together vertically in the course of handling and container filling operations. Automatic filling machines are in use which mechanically separate the lids one at a time, and automatically place them on containers which have been filled. The stacked lids tend to stick together as the result of a suction effect between adjacent lids. This problem necessarily interrupts and slows down the high speed operation of automatic filling machines.

Lids of the type to which the improved lid structure of this invention is directed are disclosed in U.S. Pat. No. 3,880,288 issued to Carl T. Hunter. Such plastic lids include a raised locating ring on the top wall of the lid which functions in combination with an adjacent shoulder on the top wall to permit convenient nesting and stacking of the lids prior to their placement on filled containers. The Hunter patent, as well as U.S. Pat. No. 4,111,329 issued to John Edward Lampman, disclose a locking bead or rim formed on the inside surface of a side wall or skirt of a plastic lid for use in securing the lid in tight engagement with a coacting rim or bead on the top of a container. The aforesaid Lampman patent discloses as stacking means elongated, vertical ribs formed on the outer surface of the lid side wall.

Efforts have been made to overcome the problem of plastic lids sticking together in stacks. U.S. Pat. No. 3,373,896 issued to Paul Davis discloses the use of cam surfaces on portions of plastic lids to assist in mechanically separating the lids one from another in a stack. U.S. Pat. No. 3,724,710 also issued to Paul Davis is more pertinent in that it discloses the use of depressions formed in the mating portions of adjacent stacked lids to define air passages for communicating the region between stacked lids with the atmosphere.

With the aforesaid prior art lid structure and lid sticking problems in mind, we have developed an improved lid construction which is particularly effective in facilitating the separation of stacked, plastic lids of conventional, stacking ring and stacking shoulder design.

BRIEF SUMMARY OF THE INVENTION

The improved plastic lid structure of this invention is particularly characterized by the provision of protruding segments and rib members on flexible, plastic lids in such a way as to provide vent passages between adjacent, stacked lids to preclude the suction effect normally tending to hold stacked lids together.

In the preferred embodiment of this invention, this basic objective is realized by providing a plurality of protrusion segments spaced apart around the inside surface of the lid side wall to thereby provide vent openings between the lid side wall and the stacking element of an adjacent stacked lid. With respect to the lids as disclosed herein, the stacking element comprises a raised stacking ring on the upper surface of the lid top wall.

The aforesaid stacking ring is spaced radially inwardly from the upper end of the lid side wall skirt in a known manner to provide a stacking shoulder on the outer periphery of the top wall. The aforesaid protrusion segments preferably extend over only a portion of the height of the lid side wall along the bottom end thereof, and are sized and located to contact the outer surface of the stacking ring on an adjacent lid. Advantageously, with respect to manufacturing and venting, the protrusion segments extend over the portion of the height of the lid side wall between the bottom of the side wall and a locking rim formed around the inside periphery of the side wall at a location between the lid top wall and the bottom of the side wall.

According to the preferred embodiment, the lid is molded plastic and the aforesaid protrusion segments are molded integrally with the lid side wall. Preferably, the protrusion segments are in the form of flat segments formed on the inner circumferential surface of the lid side wall to thereby provide wall sections of increased radial thickness.

Venting of stacked lids is further enhanced by providing upstanding lugs in the form of radial ribs on the aforesaid stacking shoulder of the lid. These lugs or ribs serve to hold the side wall of each lid vertically spaced apart from the stacking shoulder on the next lower lid to thereby provide a continuous vent passage between adjacent lids in combination with the aforesaid vent openings formed by the protruding segments on the inside of the lid side wall.

These and other objects and advantages of the invention will become readily apparent as the following description is read in conjunction with the accompanying drawings wherein like reference numerals have been used to designate like elements throughout the several views.

DESCRIPTION OF THE PREFERRED EMBODIMENT

Figure 1:
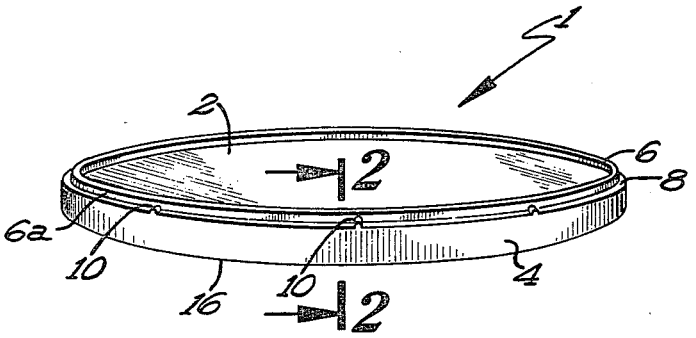
FIG. 1 is a top, perspective view of the improved lid of this invention.
Figure 2:
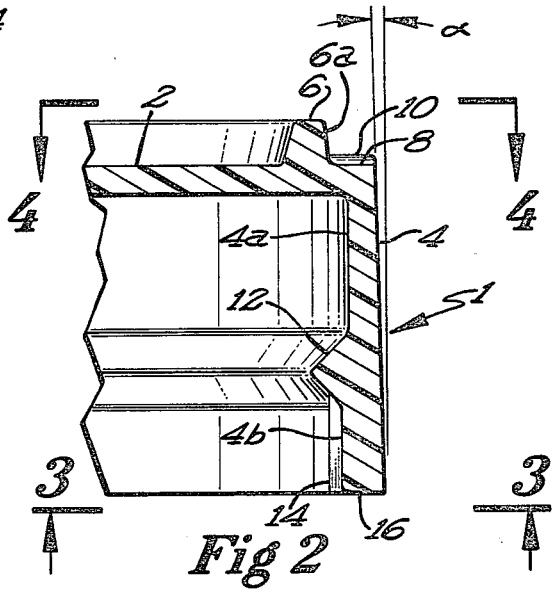
FIG. 2 is a vertical section view of the lid of FIG. 1 taken along the lines 2—2 thereof.

With reference to the drawings, the improved lid structure of this invention shown in FIGS. 1 and 2 is generally designated by reference numeral 1. The lid is of the flexible, plastic type having a planar top wall 2 and a side wall 4 depending therefrom in the form of a skirt. The lid will normally be molded from plastic material, such as polyethylene, and side wall 4 will be formed integrally with top wall 2.

Formed on the upper surface of top wall 2 is a raised stacking ring 6. Locating and stacking ring 6 extends around the periphery of top wall 2 at a location spaced radially inwardly from the upper end of side wall 4 to thereby form a stacking shoulder 8 thereon. A plurality of upstanding lugs 10 are located on stacking shoulder 8 at spaced apart positions around the top surface thereof. Lugs 10 preferably comprise ribs which extend radially on stacking shoulder 8.

A locking rim 12 extends around the inside surface of side wall 4 at a location between top wall 2 and the bottom of side wall 4. Locking rim 12 is formed as shown in a beveled or V-shaped configuration to provide a means for tightly engaging complimentary restraining means on the top of containers with which the lids are to be used. See, for example, FIG. 2 of U.S. Pat. No. 3,880,288. As may be noted with respect to FIG. 2, the upper end 4*a* of side wall 4 above locking rim 12 is of a lesser thickness than the bottom end 4*b* thereof below locking rim 12. Narrower side wall segment 4*a* may be readily flexed when bending the bottom end 4*b* inwardly and outwardly to engage and disengage locking rim 12 from the mating rim or bead on the top of a container.

Figure 5:
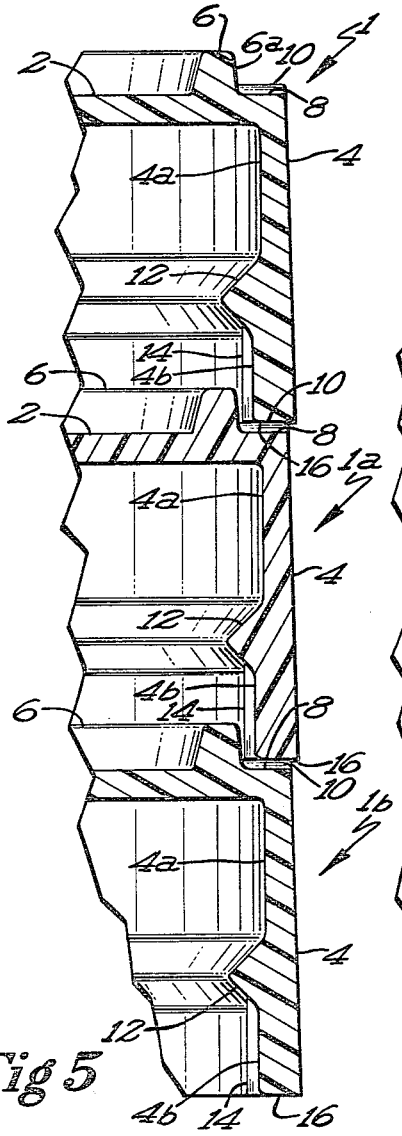
FIG. 5 is a fragmentary, vertical section view showing a plurality of the lids in stacked relation.

Lids 1 are intended to be stacked one on top of the other in the manner shown in FIG. 5 to facilitate their storage and handling. Rapid separation of the lids, one at a time, is required on container filling machines. As is disclosed in U.S. Pat. No. 4,082,203, a suction device is one means which is utilized to separate the bottom lid from a stack for conveyance to a point where it is applied to a filled container on a filling machine. With lids constructed so as to have a stacking ring 6 and stacking shoulder 8 as disclosed herein, a vacuum tends to form between adjacent, closely abutting lids when stacked as shown in FIG. 5 with the bottom, annular wall 16 of each side wall 4 resting on an adjacent stacking shoulder 8. Also, with such lids of previously known construction, the inside surface of the bottom end 4*b* of side wall 4 would normally be abutting against the outside face of stacking rings 6. For ease of stacking, the outside wall face 6*a* of stacking ring 6 is normally tapered upwardly and inwardly as shown in FIGS. 2 and 5, and side wall 4 is normally tapered in a similar manner as is indicated by the angle alpha in FIG. 2. This tapered seating of adjacent stacked lids magnifies the sticking problem.

Figure 3:
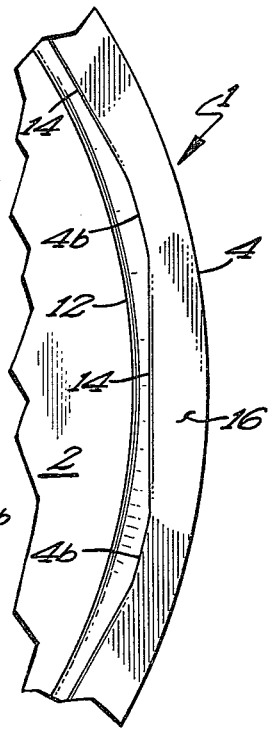
FIG. 3 is a fragmentary, bottom plan view of the lid taken along lines 3—3 of FIG. 2.
Figure 4:
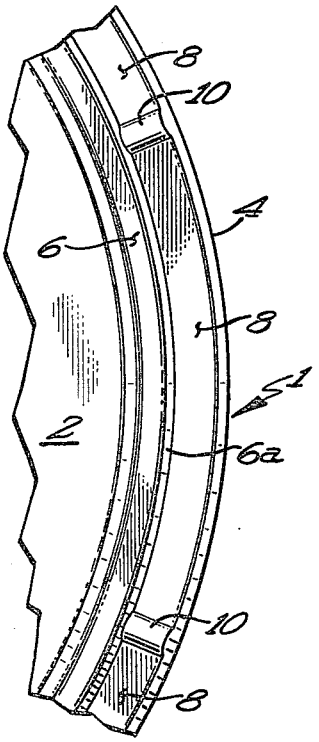
FIG. 4 is a fragmentary, top plan view of the lid taken along lines 4—4 of FIG. 2.

For the purpose of lessening, if not eliminating, the aforesaid lid sticking problem, a plurality of protrusion segments 14 are provided on the bottom end 4*b* of side walls 4 around the inside surface thereof. Protrusion segments 14 are spaced apart at predetermined intervals around side wall lower end 4*b* and project inwardly therefrom. As may best be understood by reference to FIGS. 2 and 3, protrusions 14 preferably take the form of flats formed on the inner, circular surface of side wall segment 4*b* to thereby provide wall sections on the side wall of increased radial thickness at the locations of flat segments 14. Flat segments 14 may be readily molded integrally with the lid side wall 14 in the process of molding the plastic lids. Flat segments 14 are sized and located to contact the outer surface 6*a* of stacking ring 6 of adjacent, stacked lids as shown in FIG. 5. From the standpoint of the molding process and the separating function of flat protrusions 14, they are advantageously formed to extend only over that portion of the height of side walls 4 between locking rim 12 and the bottom of side walls 4.

It will be seen that the spaces between adjacent protrusion segments or flats 14 around the inside surface of side wall bottom end 4*b* comprise vent openings between the outer surface 6*a* of stacking ring 6 and the inside surface of side walls 4 with lids 1 stacked as shown in FIG. 5. The minimal friction contact between flat segments 14 and the outer surface 6*a* of ribs 6 greatly facilitates the separation of the stacked lids. Full venting to the atmosphere of space enclosed within adjacent, stacked lids is accomplished by the communication of the aforesaid vent openings formed by flat segments 14 with the horizontally extending vent passages provided by radial ribs 10. As shown in FIG. 5, the bottom, annular surface 16 of each lid side wall 4 is supported on ribs 10 in vertically spaced relation to the surface of stacking shoulders 8. This arrangement provides the aforesaid radial or horizontal vent passages between bottom, annular seating surfaces 16 of side walls 4 and stacking shoulders 8. Suction adhesion between adjacent, stacked lids of the structure described herein is substantially eliminated by the vent passages formed by protrusion segments 14 and ribs 10.

It is anticipated that various changes may be made in the shape, size, and structural configuration of the improved stacking lid disclosed herein without departing from the spirit and scope of the invention as defined by the following claims.

What is claimed is:

1. An improved, stackable lid for containers comprising:

a substantially planar top wall, and a side wall formed integrally with said top wall from flexible material and depending from the periphery thereof as a skirt to form a container closure lid;

a raised stacking ring on the upper surface of said top wall extending around the periphery thereof at a location spaced radially inwardly from said side wall, thereby forming a stacking shoulder on said top wall between said ring and said side wall; and a plurality of protrusion segments spaced apart around the inside surface of said side wall and projecting inwardly therefrom, said protrusion segments being sized and located to contact the outer surface of a stacking ring on an adjacent one of said lids with which said lid may be vertically stacked, whereby the spaces between said protrusions around the inside surface of said side wall comprise vent openings between the stacking rings and side walls of adjacent ones of said lids when a plurality of said lids are stacked together with the bottom of the side wall of each lid resting on the said stacking shoulder of an adjacent lid.

2. A lid as defined in claim 1 wherein:

said lid is molded plastic and said protrusion segments are formed integrally with said side walls.

3. A lid as defined in claim 2 wherein:

said lid is round and said protrusion segments are defined by flat segments formed on the inner circumferential surface of said side wall to thereby provide wall sections on said side wall of increased radial thickness at the locations of said flat segments.

4. A lid as defined in claim 1 wherein:

a plurality of upstanding lugs are located on said stacking shoulder at spaced apart positions around the top surface thereof, said lugs supporting the bottom of the side wall of each lid in a stack of said lids in spaced apart relation to the stacking shoulder on the next lower lid, whereby said lugs provide, in combination with said vent openings, continuous vent passages between adjacent ones of said lids in a stack to preclude suction adhesion between adjacent, stacked lids.

5. A lid as defined in claim 4 wherein:

said lugs are in the form of ribs extending radially on said stacking shoulder.

6. A lid as defined in claim 1 wherein:

said protrusion segments extend over only a portion of the height of said side wall along the bottom end thereof with the upper end of said protrusion segments terminating below said top wall.

7. A lid as defined in claim 6 wherein:

a locking rim, for engagement with restraining means on the top of containers, extends around the inside surface of said side wall at a location between said top wall and the bottom of said side wall, and said protrusion segments extend over the portion of the height of said side wall between said locking rim and the bottom of said side wall.

* * * * *